US007861761B2

(12) United States Patent
Martineau et al.

(10) Patent No.: US 7,861,761 B2
(45) Date of Patent: Jan. 4, 2011

(54) RETRACTABLE SCREEN AND FRAME ASSEMBLY

(75) Inventors: Robert C. Martineau, Chippewa Falls, WI (US); Jeffrey V. Sawyers, Rice Lake, WI (US)

(73) Assignee: Quanex Corporation, Houston, TX (US)

( * ) Notice: Subject to any disclaimer, the term of this patent is extended or adjusted under 35 U.S.C. 154(b) by 553 days.

(21) Appl. No.: 11/196,074

(22) Filed: Aug. 3, 2005

(65) Prior Publication Data

US 2007/0029049 A1 Feb. 8, 2007

(51) Int. Cl.
*A47G 5/02* (2006.01)

(52) U.S. Cl. ..... 160/31; 160/273.1; 49/422

(58) Field of Classification Search ..... 160/31, 160/270, 271, 272, 273.1, 280, 376, 206, 160/213, 23.1, 281–288; 49/409, 414, 419, 49/422; 16/105

See application file for complete search history.

(56) References Cited

U.S. PATENT DOCUMENTS

| | | | | | |
|---|---|---|---|---|---|
| 695,692 | A | * | 3/1902 | Milans | 160/285 |
| 804,308 | A | * | 11/1905 | Forsyth | 160/282 |
| 1,015,977 | A | * | 1/1912 | Rader | 160/282 |
| 3,030,654 | A | * | 4/1962 | Migneault et al. | 16/91 |
| 3,152,354 | A | * | 10/1964 | Diack | 16/94 R |
| 3,168,355 | A | * | 2/1965 | Rudolph | 49/414 |
| 3,698,036 | A | * | 10/1972 | Goodman | 16/100 |
| 4,193,500 | A | * | 3/1980 | Scott | 206/577 |
| 4,237,664 | A | | 12/1980 | Wilmes | |
| 4,253,278 | A | * | 3/1981 | Dallaire | 49/420 |
| 4,530,189 | A | | 7/1985 | Randall | |
| 4,625,659 | A | | 12/1986 | Saelzer | |
| 4,821,786 | A | * | 4/1989 | Johnston | 160/23.1 |
| 4,986,034 | A | | 1/1991 | Mozuras et al. | |
| 5,343,594 | A | * | 9/1994 | Harvey | 16/105 |
| 5,655,342 | A | | 8/1997 | Guillemet et al. | |
| 6,199,331 | B1 | | 3/2001 | Hunt | |
| 6,283,427 | B1 | * | 9/2001 | Mø ller et al. | 248/266 |
| 6,405,781 | B2 | * | 6/2002 | Davies et al. | 160/23.1 |
| 6,408,922 | B2 | | 6/2002 | Desrochers | |
| 6,463,983 | B1 | * | 10/2002 | Lang | 160/23.1 |
| 6,478,070 | B2 | * | 11/2002 | Poppema | 160/23.1 |
| 6,814,127 | B2 | | 11/2004 | Tagtow et al. | |

* cited by examiner

*Primary Examiner*—David Purol
(74) *Attorney, Agent, or Firm*—Howard & Howard Attorneys PLLC

(57) ABSTRACT

The present invention is a retractable screen (22) and frame (24) assembly (20). The frame (24) includes a first track (32) and a second track (34) in spaced and parallel relationship to the first track (32). The retractable screen (22) includes a canister (36), a screen cloth (38), a control bar (40), a first glide (42), a second glide (44), and a biasing device (46). The biasing device (46) is disposed between a first end (52) of the control bar (40) and the first glide (42). The first glide (42) is inserted into the first track (32) and the second glide (44) is inserted into the second track (34). The glides (42, 44) slide along the respective tracks (32, 34) while the biasing device (46) biases the first end (52) of the control bar (40) with respect to the first track (32). The biasing provided by the biasing device (46) prevents the control bar (40) from binding with the tracks (32, 34) as the control bar (40) and the glides (42, 44) are slid along the tracks (32, 34).

33 Claims, 6 Drawing Sheets

RETRACTABLE SCREEN AND FRAME ASSEMBLY

BACKGROUND OF THE INVENTION

1. Field of the Invention

The invention generally relates to a retractable screen and frame assembly for covering and uncovering a door or a window opening.

2. Description of the Related Art

Traditional door or window openings are covered and uncovered with a screen and frame assembly that rolls. The opening is bounded by a frame and the assembly includes a pair of opposing tracks that are adjacent the frame in spaced and parallel relationship. The screen includes a surround having four sides and wheels on two opposing sides of the surround that correspond to the opposing tracks. When the screen is installed to the tracks inside the opening, the wheels allow the screen to roll along the tracks across the opening. However, with this type of assembly, the screen has the tendency to bind as it is rolled along the tracks. Additionally, the wheels on the surround tend to come off of the tracks, causing the screen to fall out of the frame.

Another type of screen and frame assembly that has been used is a retractable screen and frame assembly. An example of a conventional retractable screen and frame assembly is disclosed in U.S. Pat. No. 6,814,127 (the '127 patent). The '127 patent discloses an opening which is bounded by an upper track and a bottom track in spaced relationship. The tracks include a powder coat finish that reduces friction. Each track includes a rail with a round cross-section. The retractable screen assembly includes a canister, a screen cloth, and a control bar. The screen cloth is connected between the canister and the control bar. The canister includes a roller assembly for winding and unwinding the screen cloth into and out of the canister. The control bar has an upper end and a lower end. A spacer and a lower glide are disposed at the lower end. The spacer defines two holes and the spacer engages the lower end of the control bar. A pair of posts are formed on the lower glide. The posts of the lower glide are slidably inserted into the holes of the spacer. While the spacer engages the lower end of the control bar, the lower glide slides axially with respect to the end of the control bar through the holes in the spacer. The spacer is passive and therefore does not actively react between the lower glide and the lower end of the control bar. An upper glide is affixed to the upper end of the control bar. Both glides define a channel that is shaped to mate with the cross-section rails on the tracks to slidably retain the glides to the corresponding tracks. Therefore, the control bar and the upper glide are slidably engaged and suspended from the upper track and the lower glide is slidably engaged with the lower track. As the control bar and the glides slide along the tracks and the upper glide and the control bar are suspended from the upper track, the lower glide moves axially with respect to the control bar by virtue of the spacer. As the tracks vary by distance, the upper glide and the control bar follow the upper track and the lower glide follows the lower track. Any distance between the tracks is translated into the lower glide, following the lower track, to move toward or away from the lower end of the control bar. Therefore, the axial movement between the lower glide and the control bar requires the upper and lower glides to be affixed to their respective tracks. The axial movement of the lower glide with respect the spacers is aided by forming the glide from silicone, Teflon® impregnated acetal, or other friction reducing materials. However, application of these types of coatings is expensive due to the materials, time, and steps added to the assembly process.

Accordingly, it would be advantageous to provide a sliding screen assembly that does not require the use of special materials to form the components of the sliding screen assembly, i.e., silicone or Teflon® impregnated acetal, or require special processing steps, i.e., a powder coat finish. The use of the special materials and/or special processing steps adds time and cost to the manufacture of the sliding screen assembly.

SUMMARY OF THE INVENTION AND ADVANTAGES

The present invention is a retractable screen and frame assembly. The assembly includes a first pair of spaced frame members and a second pair of spaced frame members extending between the first pair of frame members to define an opening. A first track is disposed along one of the frame members of the first pair and a second track is disposed along the other one of the frame members of the first pair. A canister extends across the opening and between the first pair of frame members. A screen cloth extends between a trailing edge, supported by the canister, and a leading edge for dispensing the screen cloth from the canister to cover the opening and for retracting the screen cloth within the canister to uncover the opening. A control bar extends across the opening between a first end and a second end. The leading edge of the screen cloth is attached to the control bar between the ends thereof for guiding the leading edge of the screen cloth back and forth over the opening to cover and uncover the opening. A first glide is movably supported by the first end of the control bar for sliding along the first track. A second glide is movably supported by the second end of the control bar for sliding along the second track. A biasing device reacts between the first end of the control bar and the first glide for biasing the first glide against the first track. This biasing allows relative movement between the first end and the first glide when sliding the first glide along the first track. Therefore, the biasing device compensates for varying distances between the first track and the second track.

By placing a biasing device between the first glide and the first end of the control bar, the biasing device automatically biases the control bar axially with respect to the tracks. Therefore, the biasing device biases the control bar toward and away from the tracks. Additionally, the biasing provided by the biasing device is not dependent upon the use of friction reducing materials and processes for the glides, the tracks, and the control bar. Therefore, the biasing provided by the biasing device allows the control bar and the glides to smoothly slide along the first and the second tracks without binding even when the first and the second tracks are out of parallel with respect to each other. Similarly, if the first track and/or the second track are "bowed", the biasing provided by the biasing device also allows the control bar to glide smoothly across the tracks without binding.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

The present invention is a retractable screen and frame assembly for placement into an aperture for a window or a door. The assembly is shown generally at 20 in FIG. 1 and includes a retractable screen 22 and a frame 24.

Figure 1:
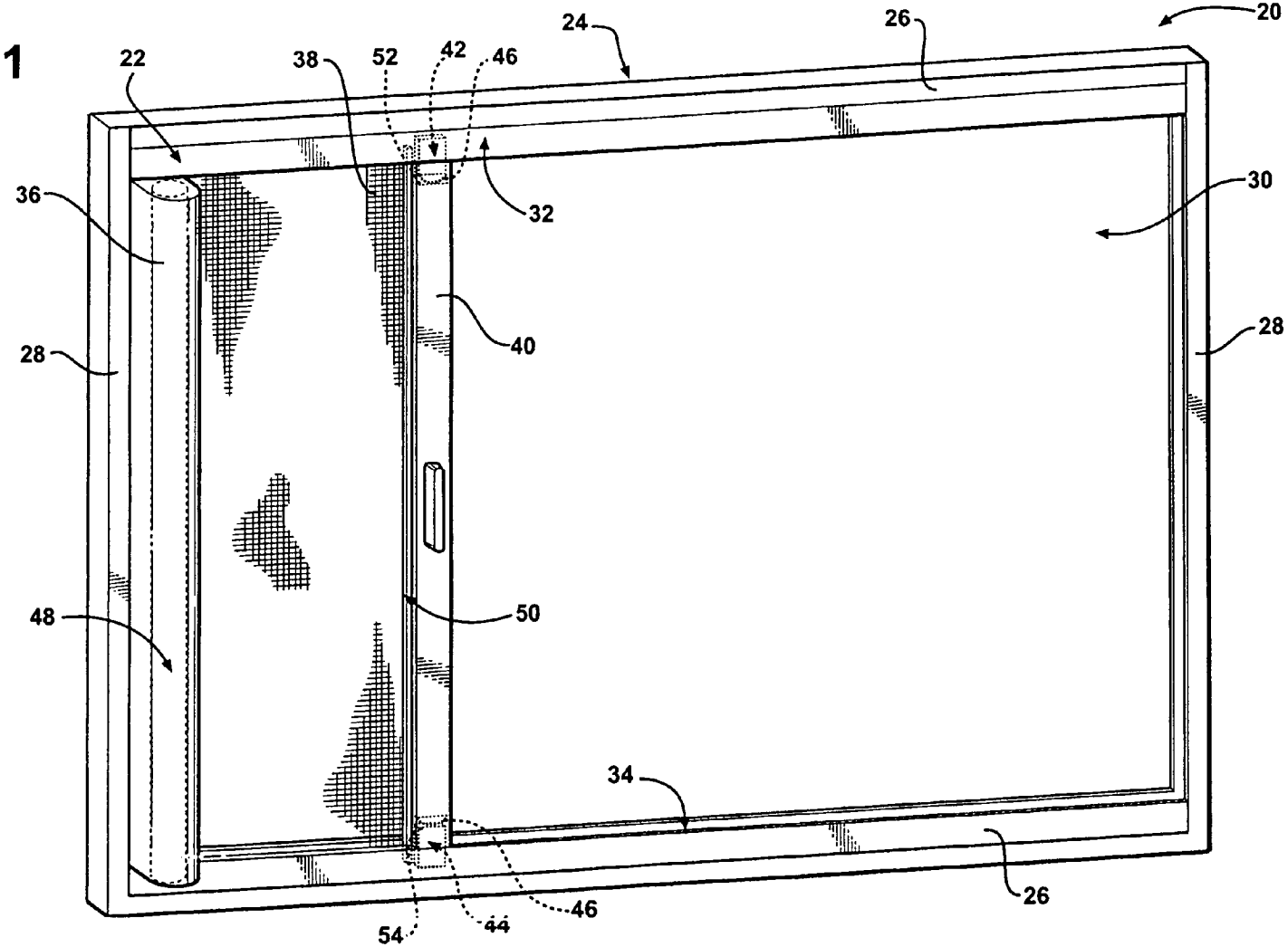
FIG. 1 is a perspective view of a retractable screen apparatus and frame assembly.

Referring to FIG. 1, the frame 24 is disposed into the aperture and the retractable screen 22 is assembled to the frame 24. The frame 24 includes a first pair of spaced frame members 26 and a second pair of spaced frame members 28 extending between the first pair of frame members 26 to define an opening 30. Generally, the first pair of spaced frame members 26 are horizontal and the second pair of spaced frame members 28 are vertical to define a square or rectangular shaped opening 30. However, the frame members 26, 28 are not limited to this orientation and may be disposed at any desired orientation. A first track 32 is disposed along one of the frame members 26 of the first pair. A second track 34 is disposed along the other one of the frame members 26 of the first pair in spaced relationship to the first track 32.

The retractable screen 22 includes a canister 36, a screen cloth 38, a control bar 40, glides 42, 44, and a biasing device 46. The canister 36 extends across the opening 30 and between the first pair of frame members 26 and is disposed adjacent one of the frame members 28 of the second pair. The screen cloth 38 extends between a trailing edge 48 and a leading edge 50. The trailing edge 48 is supported by the canister 36. The control bar 40 extends across the opening 30 between opposing ends 52, 54, which include a first end 52 and a second end 54. The first end 42 is adjacent the first track 32 and the second end 44 is adjacent the second track 34. However, the ends 42, 44 may be oriented in other directions as well. The leading edge 50 is for dispensing the screen cloth 38 from the canister 36 to cover the opening 30 and for retracting the screen cloth 38 within the canister 36 to uncover the opening 30. The leading edge 50 of the screen cloth 38 is attached to the control bar 40 between the ends 52, 54 thereof for guiding the leading edge 50 of the screen cloth 38 back and forth over the opening 30 to cover and uncover the opening 30. The screen cloth 38 is automatically retracted into the canister 36 as the control bar 40 guides the leading edge 50 of the screen cloth 38 toward the canister 36. Likewise, the screen cloth 38 is automatically dispensed from the canister 36 as the control bar 40 guides the leading edge 50 of the screen cloth 38 away from the canister 36. Typical canisters 36 contain a spring-loaded roller to which the trailing edge 48 of the screen cloth 38 is attached. As the leading edge 50 of the screen cloth 38 is moved toward the canister 36, the spring-loaded roller tensions the screen cloth 38 toward the canister 36, causing the screen cloth 38 to automatically wrap around the roller. The tension in the screen cloth 38 is between the trailing edge 48 in the canister 36 and the leading edge 50 of the screen cloth 38 at the control bar 40.

The glides 42, 44 include a first glide 42 and a second glide 44 which is identical to the first glide 42. Each glide 42, 44 is movably supported by the ends 52, 54 of the control bar 40 for sliding along the respective track 32, 34. Movably supported means that each glide 42, 44 moves axially with respect to the ends 52, 54 of the control bar 40. This axial movement between the first end 52 of the control bar 40 and the first glide 42 means that the first end 52 of the control bar 40 and the first glide 42 are in a telescoping relationship. Likewise, the control bar 40 moves axially with respect to the glides 42, 44.

The biasing device 46 is disposed between the first end 52 of the control bar 40 and the first glide 42. This positioning allows the biasing device 46 to react between the first end 52 of the control bar 40 and the first glide 42 for biasing the first glide 42 against the first track 32. When the biasing device 46 reacts between the first end 52 of the control bar 40 and the first glide 42, it allows relative movement between the first end 52 of the control bar 40 and the first glide 42 when sliding the first glide 42 along the first track 32 to compensate for varying distances between the first track 32 and the second track 34. However, it should be appreciated that the biasing device 46 is not limited to being disposed between the first end 52 of the control bar 40 and the first glide 42, but may also include a second biasing device 46 that is similarly disposed between the second end 54 of the control bar 40 and the second glide 44, as shown in FIG. 1. Regardless of whether there are one or two biasing devices 46, each biasing device 46 functions to bias the ends 52, 54 of the control bar 40 axially toward and/or away from the respective tracks 32, 34. This type of biasing allows the control bar 40 to "float" between the two glides 42, 44 as the control bar 40 and the glides 42, 44 are slid along the tracks 32, 34. Additionally, the biasing provided by either one or two biasing devices 46 force, i.e. push, the glides 42, 44 away from the ends 52, 54 of the control bar 40 and against the respective tracks 32, 34. Therefore, the glides 42, 44 remain in constant contact with the tracks 32, 34 while preventing any binding of the retractable screen 22 with respect to the tracks 32, 34.

Each end 52, 54 of the control bar 40 defines a pocket 56 for supporting the glides 42, 44. The biasing device 46 is disposed in the pocket 56 between the ends 52, 54 of the control bar 40 and the respective glide 42, 44. Referring to FIGS. 2-7, for simplicity, only the first glide 42 and the first track 32 are shown. However, it should be understood that the second glide 44 and the second track 34 are identical to those shown and described in these Figures. Each pocket 56 includes retaining walls 57 that extend to a floor 58 where the floor 58 is surrounded by the retaining walls 57. Each glide 42, 44 is generally rectangular in shape and includes a base 60 that is disposed in the pocket 56 and supported by the retaining walls 57. The glides 42, 44 also includes a body 62 having sides 63 that extend from the base 60 of the glide 42, 44 to an outer surface 64. The biasing device 46 is disposed between the base 60 of the glide 42, 44 and the floor 58 of the pocket 56. The biasing device 46 reacts between the floor 58 of the pocket 56 and the base 60 of the glide 42, 44.

Figure 3:
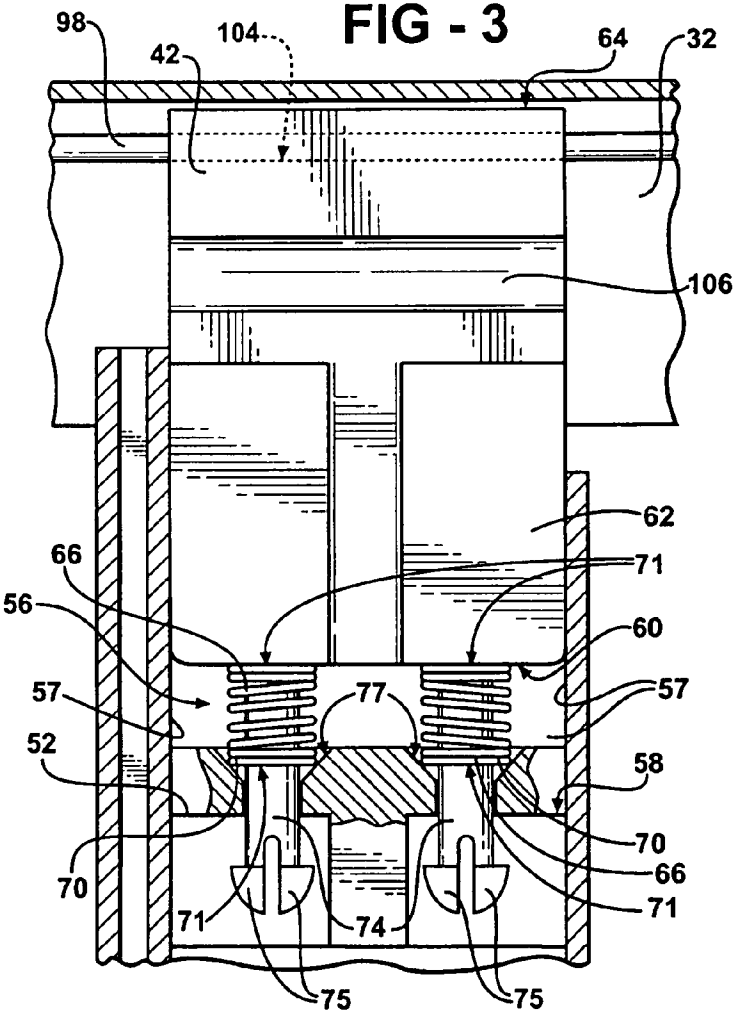
FIG. 3 is a partial cross-sectional side view of the assembly showing the biasing device from FIG. 2 in a compressed position.
Figure 2:
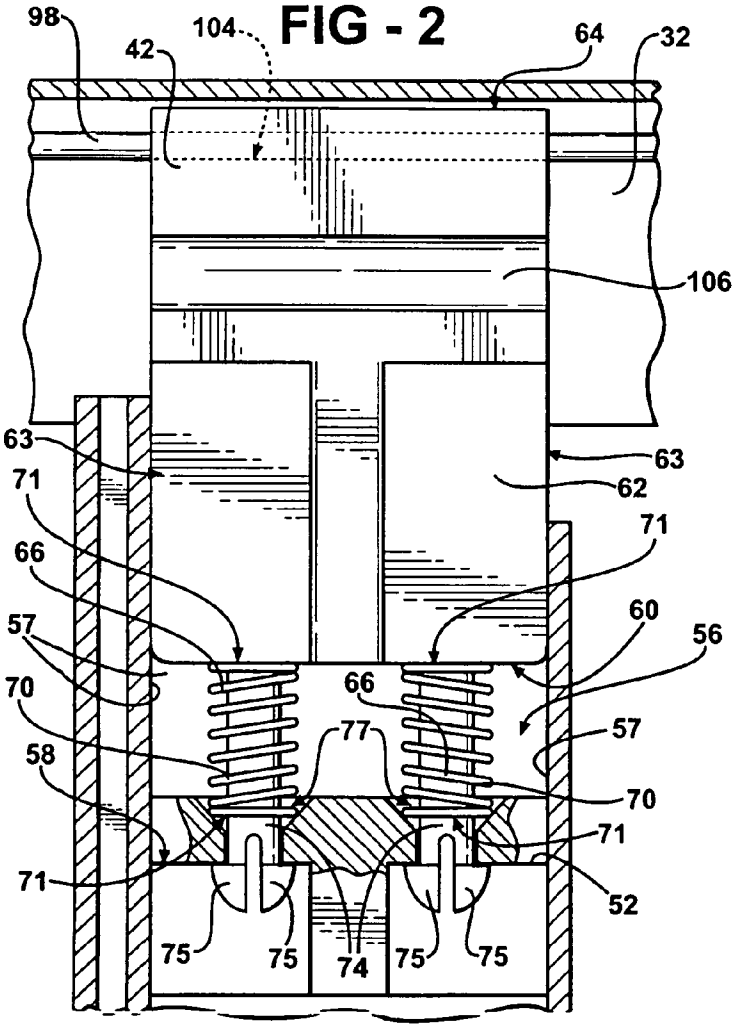
FIG. 2 is a partial cross-sectional side view of the assembly showing a biasing device in a relaxed position and disposed between a glide and a control bar.

The biasing device 46 is preferably a spring. The spring is a coil spring 66, as illustrated in FIGS. 2-3, a leaf spring 68, as illustrated in FIGS. 4-7, or any other type of device that reacts between the ends 52, 54 of the control bar 40 and the respective glides 42, 44. Referring to FIGS. 2-3, the coil spring 66 includes a ribbon 70 that extends in a spiral shape between opposing coil surfaces 71. The coil spring 66 defines a hole 72 that extends through the coil spring 66 and the coil surfaces 71. The coil surfaces 71 of the coil spring 66 react between the floor 58 of the pocket 56 and the base 60 of the respective glide 42, 44. The glide 42, 44 includes a rod 74 extending from the base 60. Preferably, the glide 42, 44 includes two rods 74 that are in spaced and parallel relationship that extend from the base 60. The floor 58 of the pocket 56 defines a gap 76 that corresponds to each of the rods 74. Each rod 74 extends through the hole 72 of the coil spring 66 and into the corresponding gap 76 in the floor 58. The coil spring 66 reacts between the floor 58 of the control bar 40 and the base 60 of the glide 42, 44. The rod 74 also includes retention fingers 75 that are L-shaped and extend from the rod 74 in spaced and parallel relationship and engage the gap 76 of the floor 58. Additionally, the floor 58 defines chamfers 77 at each gap 76. The chamfers 77 act as a lead-in for inserting the retention fingers 75 and the rod 74 into the gap 76 in the floor 58. By engaging the gap 76 of the floor 58, the retention fingers 75 retain the glide 42, 44 to the floor 58 of the control bar 40 while allowing the rod 74 to move into and out of the gap 76. While the rod 74 moves into and out of the gap 76, the retention fingers 75 engage the gap 76 in the floor 58 and the coil spring 66 reacts between the floor 58 and the base 60 of the glide 42, 44. Therefore, when the rod 74 moves out of the gap 76, the retention fingers 75 engage the gap 76 in the floor 58 and the coil spring 66 is in a relaxed position between the floor 58 and the base 60 of the glide 42, 44, as shown in FIG. 2. Likewise, when the rod 74 moves into the gap 76, the retention fingers 75 and the rod extend further into the gap 76 and the coil spring 66 is in a compressed position and reacts between the floor 58 and the base 60 of the glide 42, 44, as shown in FIG. 3.

Figure 5:
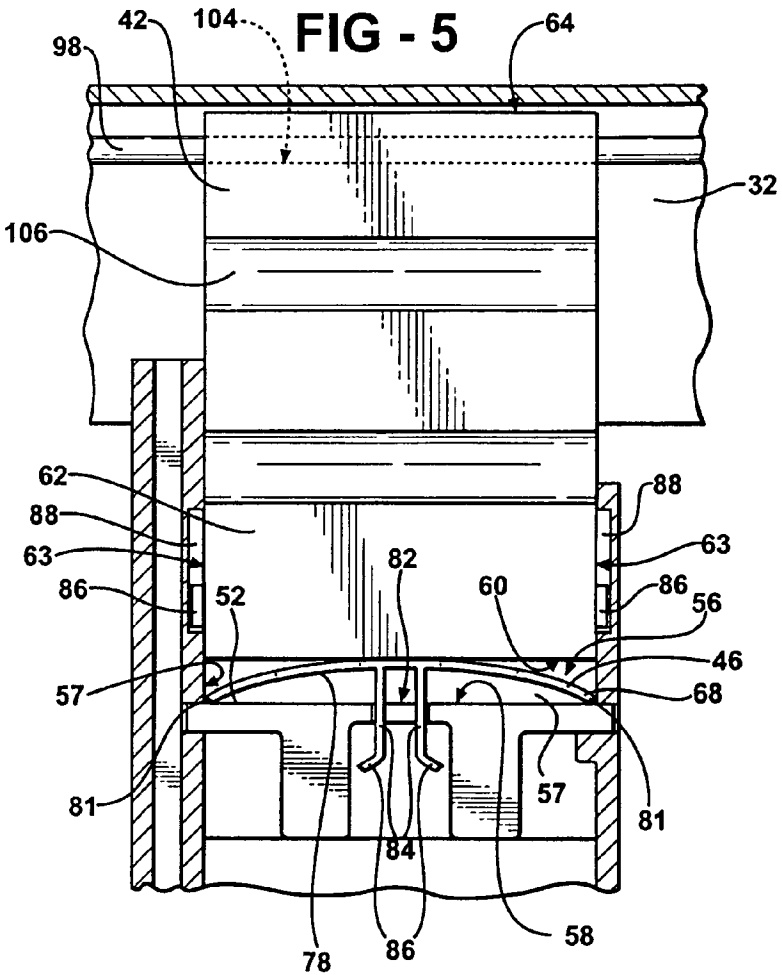
FIG. 5 is a partial cross-sectional side view of the assembly showing the biasing device from FIG. 4 in the compressed position.
Figure 4:
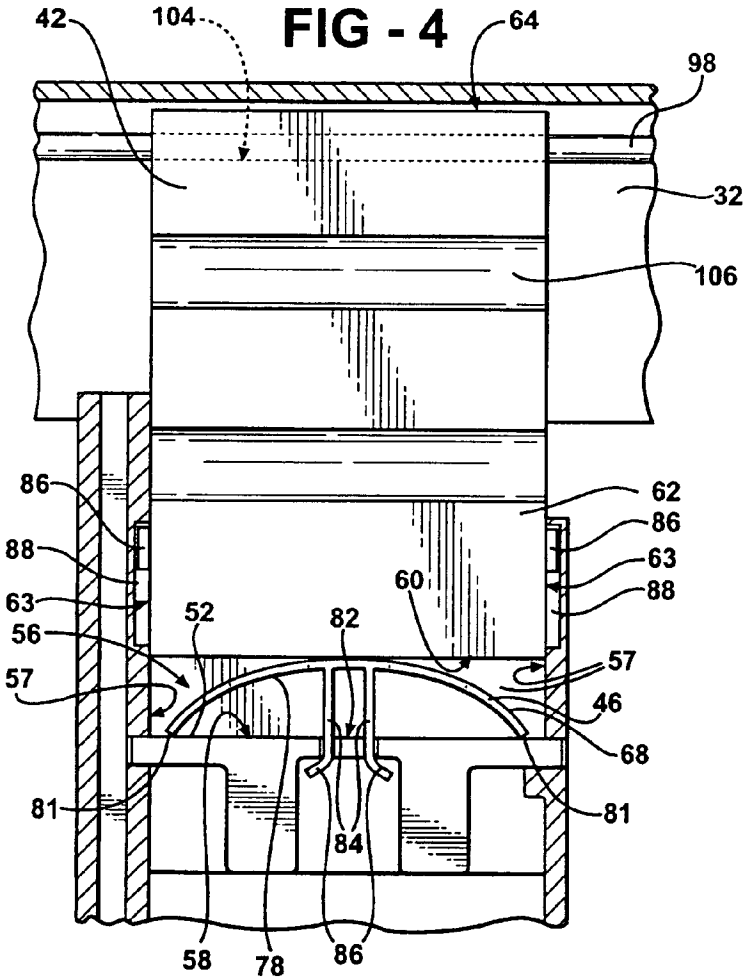
FIG. 4 is a partial cross-sectional side view of the assembly illustrating another embodiment of the biasing device engaging the control bar and in the relaxed position.

Referring to FIGS. 4-5, the leaf spring 68 may also be used as a biasing device 46. The leaf spring 68 includes a strip 78 that is arched and has a peak 80 at a midpoint of the strip 78. The strip 78 extends between opposing feet 81. The feet 81 and the peak 80 react between the floor 58 and the base 60 of the glide 42, 44. The floor 58 defines a slot 82 and the leaf spring 68 engages the slot 82 to retain the leaf spring 68 to the floor 58 of the control bar 40. While the leaf spring 68 engages the slot 82, the feet 81 and the peak 80 are reacting between the floor 58 and the base 60 of the glide 42, 44. The leaf spring 68 further includes an arm 84 that depends from the strip 78 between the feet 81. Preferably, the leaf spring 68 includes a pair of arms 84 that depend from the strip 78 in spaced and parallel relationship. A projection 86 extends from each of the arms 84, in generally opposite directions, and engages the slot 82. This engagement retains the leaf spring 68 to the floor 58. Each arm 84 moves into and out of the slot 82 as the feet 81 and the peak 80 react between the floor 58 and the base 60 of the glide 42, 44. Therefore, when each arm 84 moves out of the slot 82, the projections 86 engage the slot 82 in the floor 58 and the leaf spring 68 is in a relaxed position between the floor 58 and the base 60 of the glide 42, 44, as shown in FIG. 4. Likewise, when each arm 84 moves into the slot 82, the projections 86 and the arms 84 move further into the slot 82 in the floor 58 and the leaf spring 68 is in a compressed position between the floor 58 and the base 60 of the glide 42, 44, as shown in FIG. 5.

Figure 7:
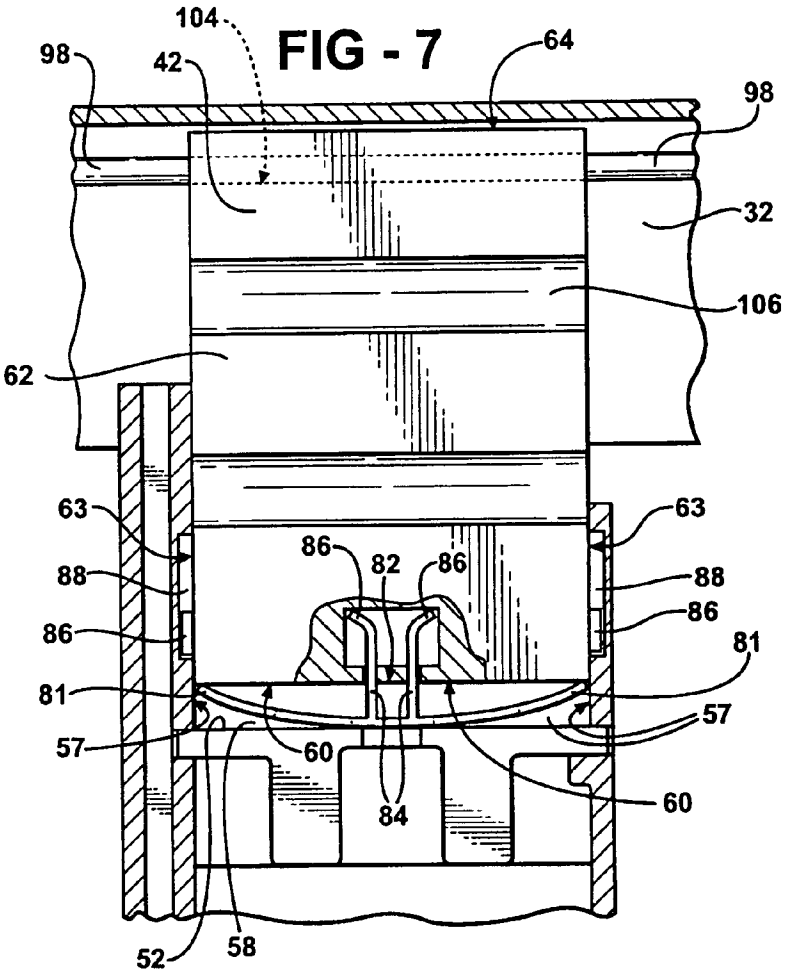
FIG. 7 is a partial cross-sectional side view of the assembly showing the biasing device from FIG. 6 in the compressed position.
Figure 6:
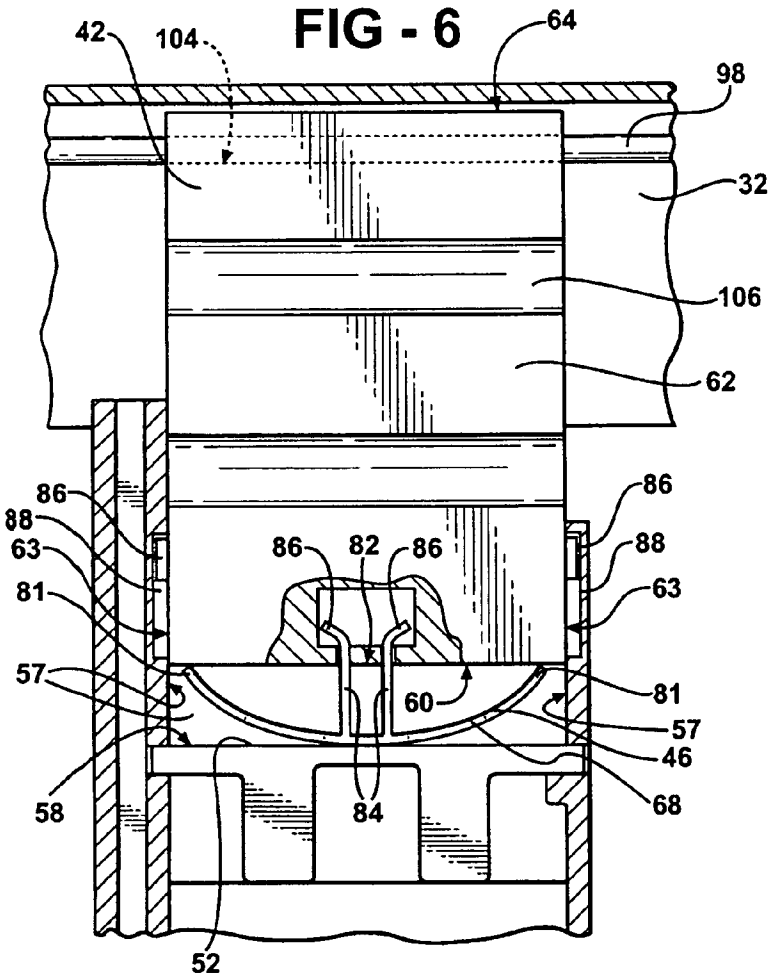
FIG. 6 is a partial cross-sectional side view of the assembly illustrating yet another embodiment of the biasing device engaging the glide and in the relaxed position.

Referring to FIGS. 6-7, the base 60 of the glide 42, 44 defines a slot 82 and the leaf spring 68 engages the slot 82 to retain the leaf spring 68 to the base 60 of the glide 42, 44 while the feet 81 and the peak 80 are reacting between the base 60 of the glide 42, 44 and the floor 58. The projections 86 that extend from the arms 84 engage the slot 82. This engagement retains the leaf spring 68 to the base 60 of the glide 42, 44. The arm 84 moves into and out of the slot 82 as the feet 81 and the peak 80 react between the base 60 of the glide 42, 44 and the floor 58. Therefore, when each arm 84 moves out of the slot 82, the projections 86 engage the slot 82 in the base 60 and the leaf spring 68 is in a relaxed position between the floor 58 and the base 60 of the glide 42, 44, as shown in FIG. 6. Likewise, when each arm 84 moves into the slot 82, the projections 86 and the arms 84 move further into the slot 82 in the base 60 and the leaf spring 68 is in a compressed position between the floor 58 and the base 60 of the glide 42, 44, as shown in FIG. 7.

When the leaf spring 68 is used, the control bar 40 includes opposing retaining walls 57 that define a pair of opposing notches 88 within the pocket 56. Likewise, a pair of tabs 90 are formed on two opposing sides 63 of the glide 42, 44 and slidably fit within the corresponding notches 88 in the pocket 56. This allows the glide 42, 44 to move axially in the telescoping relationship to the end 52 of the control bar 40 while retaining the glide 42, 44 to the end 52, 54 of the control bar 40.

Figure 8:
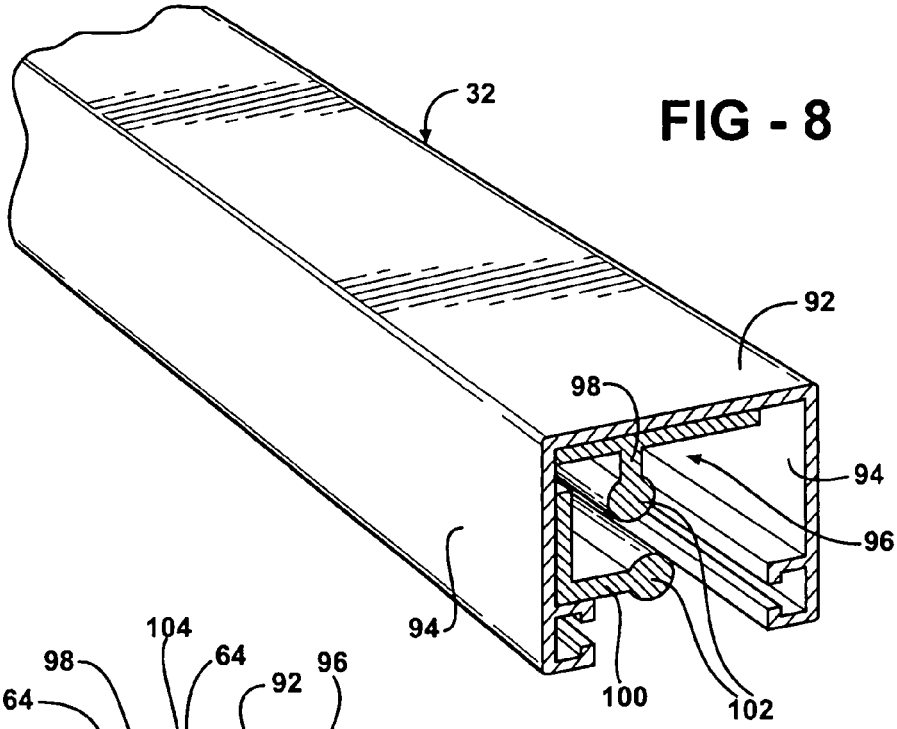
FIG. 8 is a perspective view of a track.
Figure 9:
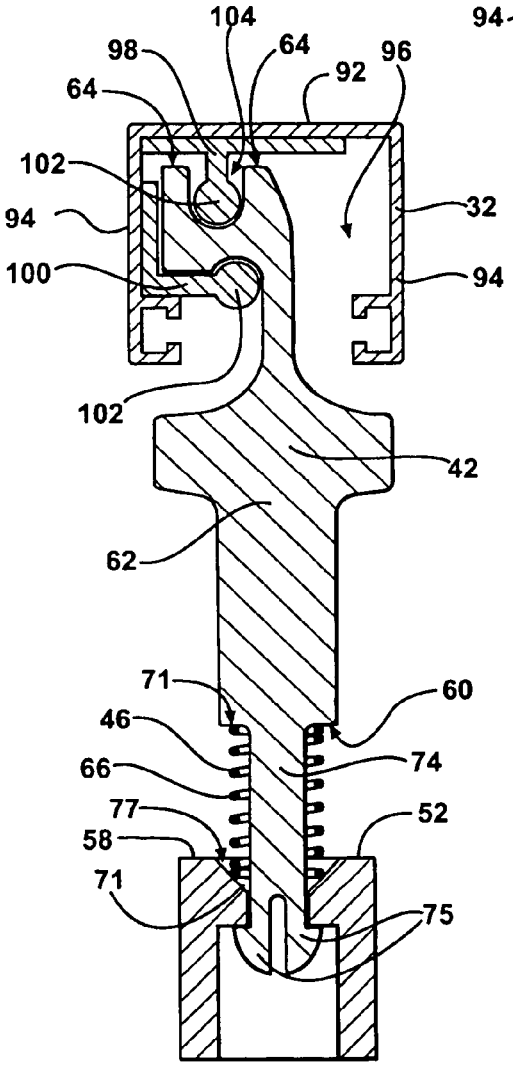
FIG. 9 is a cross-sectional side view of the glide engaged with the track and the biasing device engaging an end of the control bar and the glide.
Figure 10:
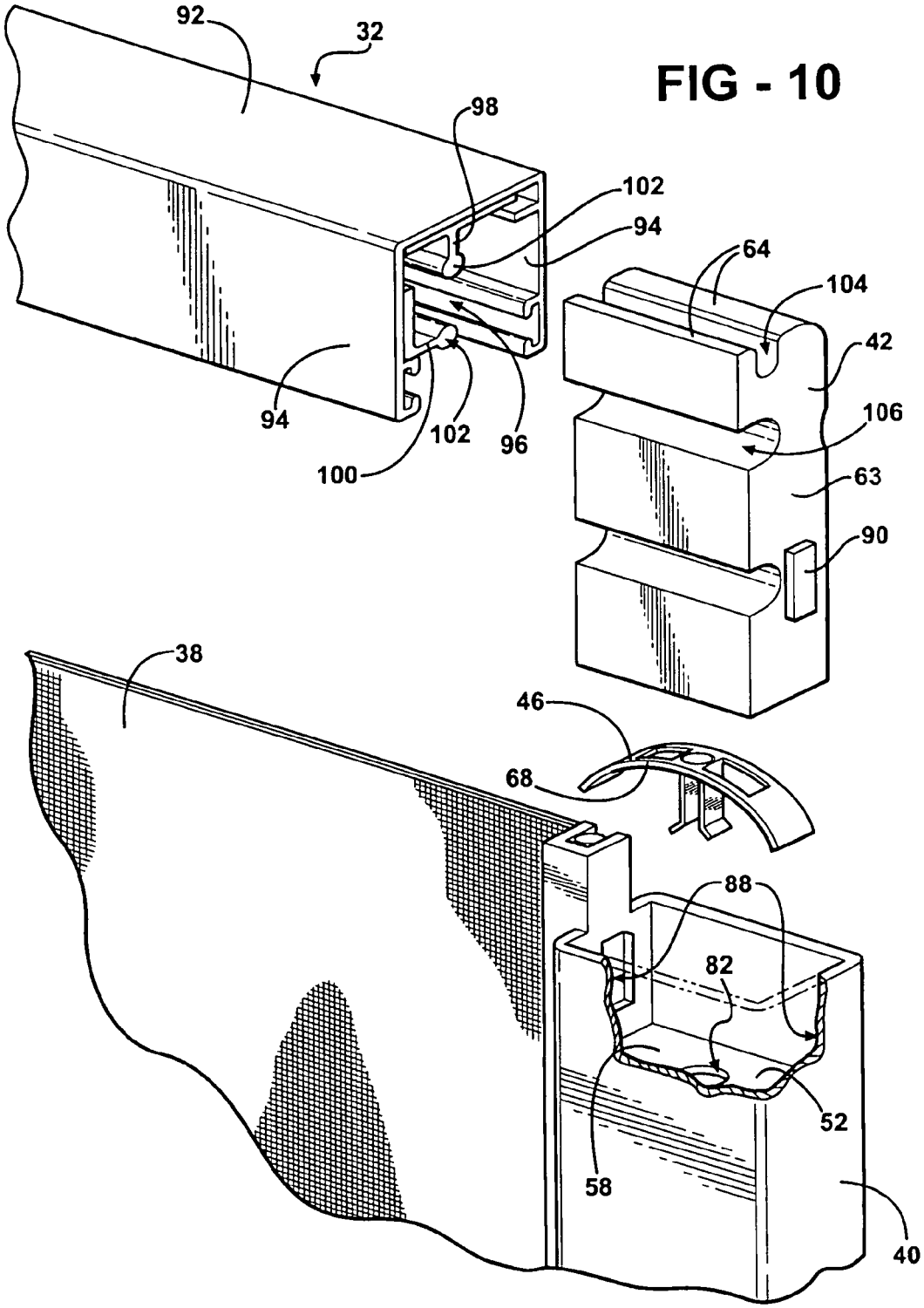
FIG. 10 is a partial perspective view of the assembly exploded and partially cut away showing the track, the glide, the biasing device, and the control bar.

The tracks 32, 34 include a platform 92 and a pair of guide walls 94 that extend perpendicularly from the platform 92 in spaced and parallel relationship. Referring to FIGS. 8-10, for simplicity, only the first track 32 is shown. However, it should be understood that the second track 34 is identical to the first track 32 that is shown and described in the Figures. The guide walls 94 and the platform 92 define a channel 96 that extends along each track 32, 34. Each track 32, 34 includes a first flange 98 that extends from the platform 92 and a second flange 100 that extends from one of the guide walls 94 and along the track 32, 34. Additionally, a cylinder 102 is formed along an edge of each of the flanges 98, 100. The body 62 of the glide 42 is disposed in the channel 96 for sliding along the channel 96 of the track 32, 34. The outer surface 64 of the body 62 defines a first groove 104 where the first groove 104 is disposed over the first flange 98. Similarly, one of the sides 63 of the body 62 defines a second groove 106 where the second groove 106 is disposed over the second flange 100. This allows the body 62 to slide along the first flange 98 and the second flange 100 in the channel 96 of the track 32, 34. Therefore, the first groove 104 and the first flange 98 and the second groove 106 and the second flange 100 cooperate to retain each glide 42, 44 in the channel 96 of the respective track 32, 34. Retaining each glide 42, 44 to its respective track 32, 34 provides further stability to the assembly 20 by keeping the glides 42, 44 and the control bar 40 aligned to prevent the glides 42, 44 from binding or coming out of the tracks 32, 34. However, it is not mandatory that the tracks 32, 34 retain each glide 42, 44 to prevent the assembly 20 from binding.

The retractable screen 22 is assembled to the frame 24 in a number of ways. The glides 42, 44 and the biasing devices 46 are assembled to the control bar 40. Then, the glides 42, 44, the biasing devices 46, and the control bar 40, are assembled as a single unit into the channels 96 of the respective tracks 32, 34. Alternatively, the glides 42, 44 are inserted into the channels 96 of the respective tracks 32, 34 and the biasing devices 46 and the control bar 40 are then assembled to the glides 42, 44 with the glides 42, 44 assembled to the tracks 32, 34. Additionally, the glides 42, 44, the biasing devices 46, and the control bar 40 may be assembled to the tracks 32, 34 before or after the tracks 32, 34 are assembled to the first pair of spaced frame members 26.

The invention has been described in an illustrative manner, and it is to be understood that the terminology which has been used is intended to be in the nature of words of description rather than of limitation. Obviously, many modifications and various of the present invention are possible in light of the above teachings, and the invention may be practiced otherwise than as specifically described.

What is claimed is:

1. A retractable screen and frame assembly comprising;

a first pair of spaced frame members, a second pair of spaced frame members extending between said first pair to define an opening, a first track disposed along one of said frame members of said first pair, a second track disposed along the other one of said frame members of said first pair, a canister extending across said opening and between said first pair, a screen cloth extending between a trailing edge supported by said canister and a leading edge for dispensing said screen cloth from said canister to cover said opening and for retracting said screen cloth within said canister to uncover said opening, a control bar extending across said opening between a first end and a second end, said leading edge of said screen cloth being attached to said control bar between said ends thereof for guiding said leading edge of said screen cloth back and forth over said opening to cover and uncover said opening, a first glide movably supported by said first end of said control bar for sliding along said first track, a second glide movably supported by said second end of said control bar for sliding along said second track, and a biasing device reacting between said first end of said control bar and said first glide for biasing said first glide against said first track to allow relative movement between said first end and said first glide when sliding said first glide along said first track thereby compensating for varying distances between said first track and said second track, said first end of said control bar defines a pocket for supporting said glide, said pocket includes retaining walls extending to a floor surrounded by said retaining walls and said first glide includes a base disposed in said pocket.

2. An assembly as set forth in claim 1 wherein said first end of said control bar and said first glide are in a telescoping relationship.

3. An assembly as set forth in claim 2 wherein said biasing device is disposed between said first end of said control bar and said first glide.

4. An assembly as set forth in claim 3 wherein said biasing member is disposed in said pocket between said first end and said first glide.

5. An assembly as set forth in claim 4 wherein said base is supported by said retaining walls with said biasing device reacting between said floor of said pocket and said base of said first glide.

6. An assembly as set forth in claim 5 wherein said biasing device is a coil spring.

7. An assembly as set forth in claim 6 wherein said coil spring includes a ribbon that extends in a spiral shape between opposing coil surfaces and defines a hole extending along said coil spring through said coil surfaces with said coil surfaces reacting between said floor and said base of said first glide.

8. An assembly as set forth in claim 7 wherein said floor of said first end defines an opening and said first glide includes a rod extending from said base of said first glide and through said hole of said coil spring and into said opening with said coil spring reacting between said floor of said pocket and said base of said first glide.

9. An assembly as set forth in claim 8 wherein said rod includes retention fingers extending from said rod in spaced and parallel relationship that engage said opening of said floor to retain said first glide to said floor with said rod moving into an out of said opening and with said coil spring reacting between said floor of said pocket and said base of said first glide.

10. An assembly as set forth in claim 5 wherein said biasing device is a leaf spring.

11. An assembly as set forth in claim 10 wherein said leaf spring includes a strip that is arched and has a peak at a midpoint of said strip and said strip extending between opposing feet with said feet and said peak reacting between said floor and said base of said first glide.

12. An assembly as set forth in claim 11 wherein said floor defines a slot and said leaf spring engages said slot to retain said leaf spring to said floor of said control bar while said feet and said peak are reacting between said floor and said base of said first glide.

13. An assembly as set forth in claim 12 wherein said leaf spring further includes an arm depending from said strip between said feet toward said floor and a projection extending from said arm and engaging said slot to retain said spring to said floor with said arm moving into and out of said slot as said feet and said peak are reacting between said floor and said base of said first glide.

14. An assembly as set forth in claim 11 wherein said base of said first glide defines a slot and said leaf spring engages said slot to retain said leaf spring to said base of said first glide while said feet and said peak are reacting between said base of said first glide and said floor.

15. An assembly as set forth in claim 14 wherein said leaf spring further includes an arm depending from said strip between said feet toward said base of said first glide and a projection extending from said arm and engaging said slot to retain said spring to said base of said first glide with said arm moving into and out of said slot as said feet and said peak are reacting between said base of said first glide and said floor.

16. An assembly as set forth in claim 1 wherein said first track includes a platform and a pair of guide walls extending perpendicularly from said platform in spaced and parallel relationship to define a channel extending along said first track and said first glide includes a body having sides extending from said base of said first glide to an outer surface with said body disposed in said channel for sliding along said channel of said first track.

17. An assembly as set forth in claim 16 wherein said first track includes a first flange extending from said platform and along said first track and said outer surface of said body defines a first groove with said first groove disposed over said first flange for sliding said body along said first flange in said channel of said first track.

18. An assembly as set forth in claim 17 wherein said first track includes a second flange extending from one of said walls in said channel and along said first track and one of said sides of said body defines a second groove with said second groove disposed over said second flange for sliding along said second flange in said channel of said first track with said first groove and said first flange and said second groove and said second flange cooperating to retain said first glide in said channel of said first track.

19. An assembly as set forth in claim 1 wherein said biasing device is a spring.

20. An assembly as set forth in claim 1 further including a second biasing device reacting between said second end of said control bar and said second glide for biasing said second glide against said second track to allow relative movement between said second end and said second glide when sliding said second glide along said second track thereby compensating for varying distances between said first track and said second track.

21. An assembly as set forth in claim 1 wherein said canister is disposed adjacent one of said frame members of said second pair.

22. A retractable screen for insertion into a frame assembly having a first pair of spaced frame members, a second pair of spaced frame members extending between the first pair to define an opening, a first track disposed along one of the frame members of the first pair, a second track disposed along the other one of the frame members of the first pair, said retractable screen comprising:

a canister for extending across the opening and between the first pair of frame members, a screen cloth extending between a trailing edge supported by said canister and a leading edge for dispensing said screen cloth from said canister to cover the opening and for retracting said screen cloth within said canister to uncover the opening, a control bar for extending across the opening and between the first track and the second track with said control bar having a first end and a second end, said leading edge of said screen cloth being attached to said control bar between said ends thereof for guiding said leading edge of said screen cloth back and forth over the opening to cover and uncover the opening, a first glide movably supported by said first end of said control bar for sliding along the first track, a second glide movably supported by said second end of said control bar for sliding along the second track, and a biasing device reacting between said first end of said control bar and said first glide for biasing said first glide against the first track to allow relative movement between said first end and said first glide when sliding said first glide along the first track thereby compensating for varying distances between the first track and the second track, said first end defines a pocket for supporting said first glide, said pocket including retaining walls extending to a floor surrounded by said retaining walls and said first glide includes a base disposed in said pocket.

23. A retractable screen as set forth in claim 22 wherein said first end of said control bar and said first glide are in a telescoping relationship.

24. A retractable screen as set forth in claim 23 wherein said biasing device is disposed between said first end of said control bar and said first glide.

25. A retractable screen as set forth in claim 24 wherein said biasing member is disposed in said pocket between said first end and said first glide.

26. A retractable screen as set forth in claim 25 wherein said base is supported by said retaining walls with said biasing device reacting between said floor of said pocket and said base of said first glide.

27. A retractable screen as set forth in claim 26 where said biasing device is a leaf spring.

28. A retractable screen as set forth in claim 26 wherein said biasing device is a coil spring.

29. A retractable screen as set forth in claim 22 wherein said biasing device is a leaf spring.

30. A retractable screen as set forth in claim 22 further including a second biasing device reacting between said second end of said control bar and said second glide for biasing said second glide against the second track to allow relative movement between said second end and said second glide when sliding said second glide along the second track thereby compensating for varying distances between the first track and the second track.

31. A retractable screen as set forth in claim 27 wherein said leaf spring includes a strip that is arched and has a peak at a midpoint of said strip and said strip extends between opposing feet with said feet and said peak reacting between said floor and said base of said first glide, one of said floor and said base defines a slot and said leaf spring engages said slot to retain said leaf spring to said one of said floor and said base while said feet and said peak are reacting between said floor and said base of said first glide, and said leaf spring further includes an arm depending from said strip between said feet toward said one of said floor and said base and a projection extending from said arm and engaging said slot to retain said spring to said one of said floor and said base with said arm moving into and out of said slot as said feet and said peak are reacting between said floor and said base of said first glide.

32. A retractable screen and frame assembly comprising:

a pair of frame members spaced from each other defining an opening therebetween, a first track disposed along one of said frame members and a second track spaced from said first track and disposed along the other one of said frame members, a canister and a screen cloth supported by said canister with said screen cloth selectively dispensable from said canister to cover said opening and selectively retractable within said canister to uncover said opening, a control bar extending across said opening between a first end and a second end with said screen cloth being attached to said control bar for guiding said screen cloth across said opening to cover and uncover said opening, a first glide movably supported by said first end of said control bar for sliding along said first track and a second glide movably supported by said second end of said control bar for sliding along said second track, and a leaf spring resiliently biasing said first glide away from said first end of said control bar for allowing relative movement between said first glide and said first end as said first glide slides along said first track, said leaf spring includes a strip that is arched and has a peak at a midpoint of said strip with said strip extending between opposing feet, one of said first end and said first glide defines a slot and said leaf spring includes an arm extending from said strip between said feet into said slot with said arm moving into and out of said slot as said first glide moves relative to said first end and said leaf spring includes a projection extending from said arm and selectively engaging said slot to retain said leaf spring to said one of said first end and said first glide.

33. A retractable screen and frame assembly comprising;

a pair of frame members spaced from each other defining an opening therebetween, a first track disposed along one of said frame members and a second track spaced from said first track and disposed along the other one of said frame members, a canister and a screen cloth supported by said canister with said screen cloth selectively dispensable from said canister to cover said opening and selectively retractable within said canister to uncover said opening;

a control bar extending across said opening between a first end and a second end with said screen cloth being attached to said control bar for guiding said screen cloth across said opening to cover and uncover said opening, a first glide movably supported by said first end of said control bar for sliding along said first track and a second glide movably supported by said second end of said control bar for sliding along said second track, and a biasing device reacting between said first end of said control bar and said first glide for biasing said first glide against said first track to allow relative movement between said first end and said first glide when sliding said first glide along said first track thereby compensating for varying distances between said first track and said second track, said first track includes a platform and a pair of guide walls extending from said platform in spaced relationship to define a channel extending along said first track, said first track includes a first flange and a second flange with said first flange extending from said platform and along said first track and with said second flange extending from one of said guide walls in said channel and along said first track, said first glide includes a body having sides extending from said base of said first glide to an outer surface with said body disposed in said channel for sliding along said channel of said first track, said outer surface of said body defines a first groove with said first groove disposed over said first flange for sliding said body along said first flange in said channel of said first track, and one of said sides of said body defines a second groove with said second groove disposed over said second flange for sliding along said second flange in said channel of said first track with said first groove and said first flange and said second groove and said second flange cooperating to retain said first glide in said channel of said first track.

* * * * *